United States Patent [19]

Lanham et al.

[11] Patent Number: 4,540,419

[45] Date of Patent: Sep. 10, 1985

[54] HUMIDITY RESISTANT MATCHES AND PROCESS FOR THE MANUFACTURE THEREOF

[75] Inventors: Albert F. Lanham, Maidstone; Michael G. C. Cox, Kingsley; Richard H. Etheridge, London, all of United Kingdom

[73] Assignee: Bryant & May Limited, England

[21] Appl. No.: 622,053

[22] PCT Filed: Oct. 19, 1983

[86] PCT No.: PCT/GB83/00266

§ 371 Date: Jun. 18, 1984

§ 102(e) Date: Jun. 18, 1984

[87] PCT Pub. No.: WO84/01572

PCT Pub. Date: Apr. 26, 1984

[30] Foreign Application Priority Data

Oct. 22, 1982 [GB] United Kingdom ..... 8230241

[51] Int. Cl.[3] ..... C06F 3/00; C06B 29/00

[52] U.S. Cl. ..... 44/42; 44/46; 44/47; 149/85

[58] Field of Search ..... 44/42, 47; 149/38, 85

[56] References Cited

U.S. PATENT DOCUMENTS

| | | | |
|---|---|---|---|
| 3,272,604 | 9/1966 | Tigrett et al. | 44/42 |
| 3,321,342 | 5/1967 | Tigrett et al. | 149/85 X |
| 3,650,712 | 3/1972 | Martin et al. | 44/42 |

FOREIGN PATENT DOCUMENTS

| | | | |
|---|---|---|---|
| 2236817 | 2/1975 | France | 44/42 |
| 2503139 | 10/1982 | France | 44/42 |

*Primary Examiner*—Carl F. Dees

*Attorney, Agent, or Firm*—St. Onge Steward Johnston & Reens

[57] ABSTRACT

In accordance with the invention humidity resistant matches having excellent and improved humidity resistance as well as excellent strike sensitivity are provided using a polyacrylic or substituted polyacrylic acid as the binder and zinc oxide as the filler, or as at least one of the components of the filler.

18 Claims, No Drawings

HUMIDITY RESISTANT MATCHES AND PROCESS FOR THE MANUFACTURE THEREOF

FIELD OF INVENTION

This invention relates to humidity resistant matches and to a process for the manufacture thereof.

BACKGROUND AND PRIOR ART

Typically, match head compositions contain a major proportion by weight of potassium chlorate in admixture with a proportion of combustible material, e.g. starch, sulphur, charcoal or phosophorus sesquisulphide; a binder; an inert filler e.g. ground glass, zinc oxide, calcium sulphate, felspar, diatomaceous earth or china clay; and minor ingredients such as a burning rate catalyst, potassium dichromate, a dye or colourant, and/or a disperant. On a percentage basis (dry weight) a typical composition may contain

| | |
|---|---|
| Potassium chlorate | 35–65% |
| Combustibles | 5–20% |
| Binder | 7–20% |
| Filler | 20–33% |
| Colourant | 0–1% |
| Catalyst | 0–1% |
| Dispersant | 0–1% |

In the case of strike-anywhere matches a significant proportion of the combustible material is provided by potassium sesquisulphide, whereas a typical safety match will contain a high proportion of potassium chlorate.

As the binder animal glues are extensively used, although other binders e.g. casein, albumen, alkyl vinyl ether/maleic anhydride copolymers, epoxy resins, polyvinyl acetate, polyvinyl alcohol, have been suggested from time to time. As match head compositions are usually applied to the match by dipping in an aqueous slurry or paste of the match head ingredients, a prime requirement of the binder is water-solubility or water-dispersibility. Also, since it is usual to incorporate into the match head a substantial quantity of air for the purpose of providing sensitivity a secondary requirement is for a binder of high foamability so that a slurry can be formed containing a high proportion of air bubbles which become incorporated into the match head. Also, of course, the binder must provide for the integrity of the head at all stages of storage, striking, ignition and combustion. Desirably also the binder is a combustible material. Although such criteria are met to a greater or lesser extent by the alternative binders mentioned, animal glue remains the binder of choice. Nevertheless animal glue possesses one major disadvantage, namely sensitivity to moisture, so that matches made therewith do not perform or store well in humid, e.g., tropical climates.

Various alternatives have been tried in order to provide a humidity resistant match head composition, including variations in the binder itself, and the provision of waterproof, e.g. shellac, coatings on the formed match head.

Typical prior art proposals for the production of humidity resistant matches are:

GB-A No. 2 098 975 which discloses humidity resistant matches comprising a conventional mixture of gelatin glue, sulphur, chlorate and conventional fillers to which has been added a proportion of an emulsified oil, e.g. linseed oil or liquid paraffin together with a proportion of hollow microspheres of a thermoplastic copolymer. Additionally, the binder in such compositions may contain 0–4% by weight of a water insoluble acrylate coplymer to increase the cohesion of the tip, such copolymer being added to the mix as an aqueous dispersion. The particular acrylate resins used in accordance with that proposal are not further identified.

Acrylate resins, more specifically acrylate ester copolymer resins, are also added to match head compositions in accordance with the teachings of FR-A No. 2 236 817 to provide humidity resistance.

Other additives providing humidity resistance in match head compositions are hollow ceramic micropheres (G.B.-B No. 1 506 185), epichlorohydrin or urea-formaldehyde resins (FR-B No. 1 515 152), polysulphides or epoxypolysulphide resins (GB No. 1 529 096), vinyl acetate (JP-A No. 74 92,209), casenite, viz a combination of casein and lime (JP-A No. 82 34,097), and various polymeric components inter alia methacrylate esters and glycerol chlorohydrin (U.S. Pat. No. 3 314 904), methyl vinyl ether/maleic anhydride copolymer (U.S. Pat. No. 3 441 456) and alkyl acrylate/catalyst combinations (Chem. Abs. 75, 152 504d, 1971).

An alternative approach has been to provide the finished match head with humidity resistant coating e.g. of cellulose acetate and chlorinated hydrocarbon (JP-A No. 74 47,510), methyl methacrylate/vinyl acetate copolymer (JP-A No. 75 04,222), shellac or notrocellulose (JP-A No. 78 62,813.

Despite all such proposals, the need still remains for an effective humidity resistant match head composition, and the present invention seeks to fulfil that need.

SUMMARY OF THE INVENTION

In accordance with the invention humidity resistant matches having excellent and improved humidity resistance as well as excellent strike sensitivity are provided using a polyacrylic or substituted polyacrylic acid as the binder and zinc oxide as the filler, or as at least one of the components of the filler.

DETAILED DESCRIPTION

In accordance with the present invention it has been found that matches with improved humidity resistance and excellent strike sensitivity can be obtained from aqueous match head compositions containing, as the binder, a water-soluble or water-dispersible salt of polyacrylic or substituted polyacrylic acid, e.g. polymethacrylic acid, with ammonia or volatile amine, and, as the filler or as a component thereof, zinc oxide, the zinc oxide being present in an approximately stoichiometric amount relative to the carboxyl groups in the polymer or above. Amounts of polyacrylic or substituted polyacrylic acid substantially in excess of the stoichiometric requirement with respect to the zinc oxide result in a decrease in humidity resistance. For the avoidance of doubt, the stoichiometric amount of zinc oxide relative to the carboxyl groups in the polyacrylic acid is defined as one mole of zinc oxide for every two molar units of the polyacrylic or substituted polyacrylic acid, i.e. for every two carboxylic acid-containing units in the polymer.

For the purposes of this specification and claims, the term "polyacrylic acid" is deemed to include substituted polyacrylic acids, e.g. polymethacrylic and polychloroacrylic acid unless the context requires otherwise.

Although the present invention is not to be restricted by any theory, the polyacrylic acid binder used in accordance with the invention is believed to undergo cross-linking with the zinc oxide during the drying stage with concomitant evaporation of the ammonia or volatile amine salt according to the following reaction scheme:

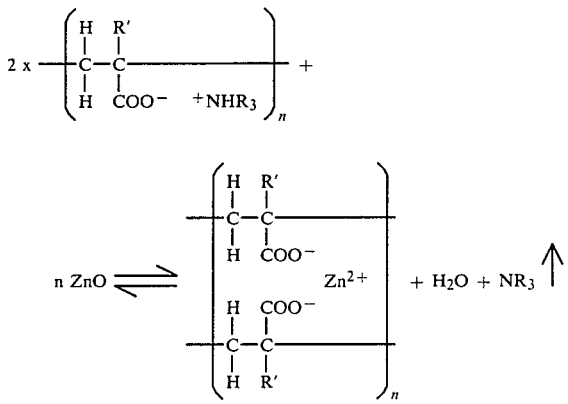

Insoluble complex where R′ is H or $CH_3$ or other low molecular weight substituent (e.g. Cl or $C_2$–$C_4$ alkyl), n is an integer and $NR_3$ is ammonia or a volatile amine, i.e. a compound where R is H or a low molecular weight organic group, e.g. $C_1$–$C_4$ alkyl, the R groups being the same or different, and optionally any two thereof being joined together to form with the N atom, a 5or 6-membered heterocyclic ring compound e.g. pyridine or piperidine. Suitable volatile amines include methylamine, ethylamine and pyridine, but for best results, the ammonium salts are preferred.

Generally the molar ration of carboxyl groups in the polymer to zinc oxide will be from 1.7:1 to 2.5:1, preferably about pb 2:1. The molecular weight of the polyacrylic acid will usually be in the range 100,000 to 1,000,000, preferably 200,000 to 300,000 in order to ensure adequate solubility or water dispersibility of the polymer salt is the aqueous match head composition used in the match dipping process. Preferably the polyacrylic acid is added to the match head composition as an aqueous solution or dispersion neutralised by the addition of a base, preferably ammonia or ammonium hydroxide, and preferably in an amount to provide an aqueous match head composition having a pH in the range 8–9. Moreover, since the polyacrylic acid salt possesses defoaming rather than foamforming properties it will usually be necessary, in the aqueous slurry compositions used in this invention, to include a foaming agent e.g. a surface active agent as a sodium dialkyl sulpho succinamate or triethanolamine lauryl sulphate in order to achieve a stable slurry with a sufficient degree of aeration. However, an adequate density and aeration by the slurry can also be achieved together with stability by incorporating as a filler or as a component thereof, glass or ceramic microspheres in the manner taught in our U.K. Patent Specification No. 1,506,185. Such microspheres may be present in amounts of from 1–33% by weight of the total composition (dry solids basis), preferably from 5 to 15%

Further, in accordance with the invention, in order to obtain satisfactory cohesion of match heads containing polyacrylic acid as the binder it has been found desirable to incorporate into the composition a cohesion promotor, preferably a combustible material, such as starch or modified starch derivative, e.g. a partially hydrolysed or esterified starch. Particularly suitable as cohension promoters are starch acetate and thin boiling starches are obtained from natural, unmodified starch by an acid and/or oxidation treatment which results in the breakdown of the starch macromolecules into smaller units. Other suitable cohesion promoters are water-soluble and water-dispersible cellulose derivatives and water-soluble and water-dispersible synthetic organic polymers and copolymers, e.g. ethylene/vinyl acetate copolymers, vinyl acetate/acrylic copolymers, styrene/acrylic copolymers, vinyl acetate/vinylchloride/ethylene terpolymers, poly(vinyl acetate), polyacrylates, and other vinyl ester polymers and copolymers with olefinic comonomers such as ethylene, e.g. polymers of the vinyl ester of versatic acid (a mixture of predominantly tertiary, cyclic carboxylic acids of 9 to 11 carbon atoms) with or without ethylene as a comonomer. The weight ratios of polyacrylic acid salt to cohension promoter may range from 1:5 to 5:1, preferably from 1:3 to 3:1, and most preferably about 1:1.

In order to obtain an aqueous match head composition of satisfactory rheology for the dipping process, i.e. suitable for the formation of a properly shaped match head by the dipping of the match splints into the aqueous match head composition, possibly two or more times to form a head thereon, and subsequent drying of the head, it may be necessary to include one or more viscosity modifying agents in the aqueous match head composition, particularly in those cases where a water-dispersible organic polymer, such as vinyl acetate/ethylene copolymer, is used as the cohesion promoting agent. Any suitable viscosity modifying agent known in the art may be used, preferably combustible materials, e.g. water-soluble starch or cellolosic derivatives, such as the starch derivatives already mentioned. Such starches therefore serve both as a cohension promotor and viscosity modifier and may hence be used alone in the compositions of the invention. Alternatively they may be used in combination with a water-soluble or water-dispersible coplymer, in which case their function is more that of a viscosity modifier than cohesion promoter, which purpose is served by the copolymer. It is obvious for that reason that the compositions of this invention preferably contain a water-dispersible starch as a combined cohension promoting and viscosity modifying agent.

In general, match head compositions used in accordance with this invention will contain, on a dry weight basis:

| | |
|---|---|
| Potassium chlorate | 40–60% |
| Binder, i.e. the polyacrylic acid salt | 3–7% |
| Cohesion promoter | 3–7% |
| Viscosity modifier | 0–7% |
| Zinc oxide | 2.5–4% |
| Foaming agent (surfactant) | 0–0.4% |
| Foam stabilizers | 0.8% |
| Other combustibles (sulphur, phosphorus sesquisulphide etc.) | 0.–10% |
| Fillers (e.g. microspheres, flour glass, calcium sulphate, fluorspar diatomaceous earth, china clay, | 10–30% |

-continued

| | |
|---|---|
| iron oxide, manganese dioxide, etc.) | |
| Burning rate catalyst | 0–1% |
| Colourant | 0–1% |

For application to the match stem in a traditional dipping process the above ingredients will be formed as a slurry in water and aerated as may be necessary to give the required density and sensitivy, and at a total solids, content of from 40–60% based on the total slurry weight. Suitable stabilizers which may be added, if necessary, to give the necessary stability to the foam include, in particular, water dispersible polyvinyl pyrrolidone and polyvinyl acetate with molecular weights of the order of 44,000. Other aqueous foam stabilizers known in the art may also be used.

The procedures used in accordance with this invention to form the match head are entirely conventional, and do not need to be described herein, the novelty of the present invention residing in the compositions used, and particulary the binder component.

Specific formulations for use in accordance with the present invention are given in the following Examples: all percentages are by weight or a dry solids basis.

EXAMPLE 1

| Safety match composition: | |
|---|---|
| Potassium chlorate | 50.25% |
| Polyacrylic acid ammonium salt (Mol. Wt. 250,000,) | 6.28% |
| Starch acetate (Amylogum CLS) | 6.28% |
| Flour glass | 6.28% |
| Glass microspheres (Armospheres) | 12.56% |
| Zinc oxide | 3.14% |
| Iron oxide | 1.57% |
| Manganese dioxide | 6.28% |
| Potassium dichromate | 1.05% |
| Sulphur | 6.28% |

EXAMPLE 2

| Safety match composition: | |
|---|---|
| Potassium chlorate | 53.45% |
| Polyacrylic acid ammonium salt (M.W. 250,000,) | 6.68% |
| Starch acetate (Amylogum CLS) | 6.68% |
| Flour glass | 20.04% |
| Zinc oxide | 3.34% |
| Iron oxide | 1.67% |
| Potassium dichromate | 1.11% |
| Sulphur | 6.68% |
| Sodium dialkyl sulpho succinamate (Alcopol FA) | 0.33% |

Yet further safety match compositions in accordance with the invention are illustrated by Examples 3–5 below:

| | Ex. 3 | Ex. 4 | Ex. 5 |
|---|---|---|---|
| Potassium chlorate | 50.25% | 55.3% | 55.3% |
| Polyacrylic acid ammonium salt (Mol Wt 250,000) | 6.28% | 6.66% | 6.66% |
| Starch acetate | 6.28% | 3.17% | 3.17% |
| Polyvinyl acetate (Vinamal 6000) | — | — | 3.39% |
| VA/VC/E* copolymer (Vinamal 3401) | — | 3.39% | — |
| Flour glass | 6.28% | 14.0% | 14.0% |
| Glass microspheres | 12.56% | — | — |
| Infusoria | — | 5.65% | 5.65% |

-continued

| | Ex. 3 | Ex. 4 | Ex. 5 |
|---|---|---|---|
| Zinc oxide | 3.14% | 3.80% | 3.80% |
| Iron oxide | 1.57% | — | — |
| Manganese dioxide | 6.28% | — | — |
| Potassium dichromate | 1.05% | 1.11% | 1.11% |
| Sulphur | 6.28% | 6.66% | 6.66% |
| Stabiliser (PVP* Mol. Wt. 44,000) | — | 0.28% | 0.28% |

*VA = vinyl acetate
VC = vinyl chloride
E = ethylene
PVP = polyvinyl pyrrolidone.

An illustrative humidity resistant strike anywhere composition in accodance with this invention is illustrated by Example 6.

| | |
|---|---|
| Potassium chlorate | 40.0% |
| Polyacrylic acid ammonium salt Mol. Wt. 250,000 | 5.72% |
| Starch acetate | 11.42% |
| Inert fillers | 28.86% |
| Zinc oxide | 5.70% |
| Phosphorus sesquisulphide | 8.0% |
| Eosin (colourant) | 0.3% |

Matches formed from the above compositions by dipping match splints into an aqueous and aerated dispersion of the specified ingredients to form a bulb thereon, and subsequently drying of the bulb to form the match head, are found to have good strike sensitivity and burning properties and good humidity resistance. After 24 hours at 95% relative humidity the success (ignition) rate on striking was excellent, approaching 100% successful ignitions. Under the same conditions, similar match head compositions but with animal glue as the binder fail completely, i.e. no successful ignition.

We claim:

1. A process for the manufacture of humidity resistant matches which comprises forming a bulb of an aqueous match head composition on the end of a match splint, and drying the bulb to form the match head, said compostion comprising a mixture of potassium chlorate, filler, combustible material and a water-soluble or water-dispersible binder therefor, characterised in that the aqueous match head composition comprises, as said binder, a water-soluble or water-dispersible salt of a polyacrylic or substituted polyacrylic acid with ammonia or a volatile amine and as said filler, or as a component thereof, zinc oxide.

2. A process to claim 1, characterised in that the molar ratio of zinc oxide to polyacrylic or substituted polyacrylic acid in said composition is in the range 1.7:1 to 2.5:1.

3. A process according to claim 1 or 2, characterised in that the binder is a water-soluble or water-dispersible salt of polyacrylic acid.

4. A process according to claim 1, 2 or 3, characterised in that the binder has a molecular weight in the range 200,000 to 300,000.

5. A process according to any one of claims 1–4, characterised in that said salt is an ammonium salt.

6. A process according to any one of claims 1–5, wherein the aqueous match head composition has a pH in the range 8–9.

7. A process according to any of claim 1–6, characterised in that the molar ratio of zinc oxide carboxylic acid groups (in free acid or salt form) is about 2:1.

8. A process according to any one of the preceding claims, characterised in that the polyacrylic or substitued polyacrylic acid salt is present in the aqueous match head composition in an amount of from 3–7% by weight, based on the dry weight of the composition.

9. A process according to any one of the preceding claims, characterised in that there is also present in the match head composition a water-soluble or water-dispersible cohesion promoting agent.

10. A process according to claim 9, characterised in that cohesion promoting agent is a water-soluble or water-dispersible starch or starch derivative, or a water-soluble or water-dispersible cellulose derivative.

11. A process according to claim 9, characterised in the cohesion promoting agent is a water-soluble or water-dispersible sythetic organic polymer or copolymer, and wherein the aqueous match-head composition also contains a viscosity modifying agent.

12. A process according to claim 11, wherein the cohesion promoting agent is selected from copolymers of ethylene and vinyl acetate, vinyl acetate/acrylic copolymers, strene/acrylic copolymers, vinyl acetate/-vinyl chloride/ethylene terpolymers, polyvinyl acetate, polyacrylates, and copolymers of ethylene and the vinyl ester of versatic acid.

13. A process according to claim 11 or 12, characterised in that the viscosity modifying agent is a water-soluble or water-dispersible starch or starch derivative.

14. A process according to any one of the claims 9–13, characterised in that the cohesion promoter is present in the aqueous match head compsotion in an amount of from 3 to 7% by weight based on the dry weight of the composition.

15. A process according to any of claims 9–14, characterised in that the weight ratio of said salt to the cohesion promoting agent in the aqueous match head compostion is in the range 1:3 to 3:1.

16. A process according to claim 15, characterised in that said ratio is about 1:1.

17. A humidity resistant match comprising a match splint and a head formed thereon from a match head composition ignitable by striking on a surface and comprising a filler, potassium chlorate, a combustible material and a binder therefor, characterised in that the filler is or comprises zinc oxide and the binder is a polyacrylic or substituted polyacrylic acid.

18. a match according to claim 17, characterised in that the match head contains as a cohesion promoting agent a water-soluble or water-dispersible starch or starch derivative, a water-soluble or water-dispersible cellulose derivative or a water-soluble or water-dispersible synthetic organic polymer.

* * * * *

UNITED STATES PATENT AND TRADEMARK OFFICE

CERTIFICATE OF CORRECTION

PATENT NO. : 4,540,419

DATED : September 10, 1985

INVENTOR(S) : Lanham et al

It is certified that error appears in the above-identified patent and that said Letters Patent are hereby corrected as shown below:

Column 6, lines 51-54 change "A process to claim 1, characterised in that the molar ratio of zinc oxide to polyacrylic or substituted polyacrylic acid in said composition is in the range 1.7:1 to 2.5:1." and insert -- A process according to claim 1 characterised in that the molar ratio of carboxylic acid groups in the polyacrylic acid or substituted polyacrylic acid to zinc oxide is in the range 1.7:1 to 2.5:1 --.

Column 6, lines 66-68 change "A process according to any of claim 1-6, characterised in that the molar ratio of zinc oxide carboxylic acid groups (in free acid or salt form) is about 2:1." and insert -- A process according to any one of claims 1-6, characterised in that the molar ratio of carboxylic acid groups (in free acid or salt form) to zinc oxide is about 2:1 --.

Signed and Sealed this

*Twenty-first* Day of *January 1986*

[SEAL]

*Attest:*

DONALD J. QUIGG

*Attesting Officer*

*Commissioner of Patents and Trademarks*